US008505304B2

(12) United States Patent
Myers et al.

(10) Patent No.: US 8,505,304 B2
(45) Date of Patent: Aug. 13, 2013

(54) FUEL NOZZLE DETACHABLE BURNER TUBE WITH BAFFLE PLATE ASSEMBLY

(75) Inventors: Geoffrey D. Myers, Simpsonville, SC (US); Scott Simmons, Greenville, SC (US); Stephen R. Thomas, Simpsonville, SC (US); Donald Mark Bailey, Greenville, SC (US); David Martin Johnson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 717 days.

(21) Appl. No.: 12/325,559

(22) Filed: Dec. 1, 2008

(65) Prior Publication Data

US 2010/0132364 A1 Jun. 3, 2010

(51) Int. Cl.
*F23R 3/14* (2006.01)

(52) U.S. Cl.
USPC ..... 60/748; 60/737; 60/804

(58) Field of Classification Search
USPC ..... 60/737, 740, 742, 746, 747, 748, 60/800, 804
See application file for complete search history.

(56) References Cited

U.S. PATENT DOCUMENTS

| | | | | | |
|---|---|---|---|---|---|
| 3,741,483 | A * | 6/1973 | Kawaguchi | 239/400 |
| 3,886,736 | A * | 6/1975 | Kawaguchi | 60/748 |
| 4,078,377 | A * | 3/1978 | Owens et al. | 60/39.23 |
| 4,812,106 | A * | 3/1989 | Purgavie | 415/139 |
| 5,228,283 | A * | 7/1993 | Sciocchetti | 60/775 |
| 5,449,286 | A * | 9/1995 | Snyder et al. | 431/9 |
| 5,672,047 | A * | 9/1997 | Birkholz | 415/160 |
| 5,983,642 | A | 11/1999 | Parker et al. | |
| 6,152,052 | A * | 11/2000 | Saxon et al. | 110/262 |
| 6,438,961 | B2 | 8/2002 | Tuthill et al. | |
| 6,675,581 | B1 * | 1/2004 | Stuttaford et al. | 60/737 |
| 6,880,340 | B2 * | 4/2005 | Saitoh | 60/737 |
| 6,993,916 | B2 | 2/2006 | Johnson et al. | |
| 2005/0268618 | A1 | 12/2005 | Johnson et al. | |
| 2008/0148736 | A1 | 6/2008 | Ishizaka et al. | |
| 2008/0289341 | A1 | 11/2008 | Ishizaka et al. | |

* cited by examiner

*Primary Examiner* — William H Rodriguez
*Assistant Examiner* — Carlos A Rivera
(74) *Attorney, Agent, or Firm* — Armstrong Teasdale LLP

(57) ABSTRACT

A fuel nozzle for use with a combustion chamber defined within a gas turbine engine and a method for assembling the same are provided. The fuel nozzle includes a swirler assembly and a burner tube that is coupled to a support flange in a detachable manner such that an inner surface of the burner tube circumscribes an outer surface of the swirler assembly during fuel nozzle operation.

11 Claims, 5 Drawing Sheets

104

FUEL NOZZLE DETACHABLE BURNER TUBE WITH BAFFLE PLATE ASSEMBLY

BACKGROUND OF THE INVENTION

The present invention relates generally to gas turbine engines and, more particularly, to a detachable burner tube for use with a gas turbine engine.

Known fuel nozzle assemblies mix air and fuel for combustion. A burner tube assembly is the outermost component of at least some known fuel nozzle assemblies and is designed to protect a plurality of internal components within the fuel nozzle assembly while channeling the air/fuel mixture through the fuel nozzle assembly. Within at least some known burner tube assemblies, a plurality of components are welded together along a plurality of seams.

Assembling known burner tube assemblies, specifically the welding process, may be a difficult task. For example, inlet air flow is determined by the burner tube assembly at the time of assembly and is generally inflexible to any subsequent changes. More specifically, to implement a design change to the air flow generally requires replacement of the entire fuel nozzle assembly. In addition, during assembly, any damage to the burner tube assembly itself may require a repair of the entire fuel nozzle assembly. The assembly process is further complicated by the burner tube assembly, which limits access to the internal components of the fuel nozzle assembly, thus making such components difficult to inspect and service.

Within known fuel nozzle assemblies, the burner tube assembly is designed such that the air flow becomes substantially uniform as it flows downstream. During operation, however, the seams created between the components coupled together may create flow anomalies, such as recirculation zones, that may adversely affect the operation of the fuel nozzle assembly. As such, during assembly, each joint requires special attention to prevent flame holding issues wherein trapped fuel and air may automatically ignite. Moreover, some known burner tube assemblies are not coupled to a support flange, and, in such tubes, a first natural bending frequency of the fuel nozzle assembly may be low enough to be excited by rotor speed multiples, thus increasing a risk of part failure due to vibration.

BRIEF SUMMARY OF THE INVENTION

In one aspect, a method for assembling a fuel nozzle for use with a combustion chamber defined within a gas turbine engine is provided. The method includes providing a swirler assembly, providing a burner tube, and coupling the burner tube to a support flange in a detachable manner such that an inner surface of the burner tube circumscribes an outer surface of the swirler assembly during fuel nozzle operation.

In another aspect, a fuel nozzle configured to channel fluid toward a combustion chamber defined within a gas turbine is provided. The fuel nozzle includes a swirler assembly and a burner tube that is coupled to a support flange in a detachable manner such that an inner surface of the burner tube circumscribes an outer surface of the swirler assembly during fuel nozzle operation.

In yet another aspect, a gas turbine engine is provided. The gas turbine engine includes a combustion chamber and a fuel nozzle configured to channel fluid toward the combustion chamber. The fuel nozzle includes a swirler assembly, a burner tube, and a support flange, wherein the burner tube is coupled to the support flange in a detachable manner such that an inner surface of the burner tube circumscribes an outer surface of the swirler assembly during fuel nozzle operation.

DETAILED DESCRIPTION OF THE INVENTION

The exemplary methods and systems described herein overcome the disadvantages of known fuel nozzle assemblies and provide a fuel nozzle assembly that is simpler to assemble, disassemble, and service in comparison to known fuel nozzle assemblies.

The terms "axial" and "axially" as used in this application refer to directions and orientations extending substantially parallel to a center longitudinal axis of a centerbody of a burner tube assembly. The terms "radial" and "radially" as used in this application refer to directions and orientations extending substantially perpendicular to the center longitudinal axis of the centerbody. The terms "upstream" and "downstream" as used in this application refer to directions and orientations relative to an axial flow direction with respect to the center longitudinal axis of the centerbody.

Figure 1:
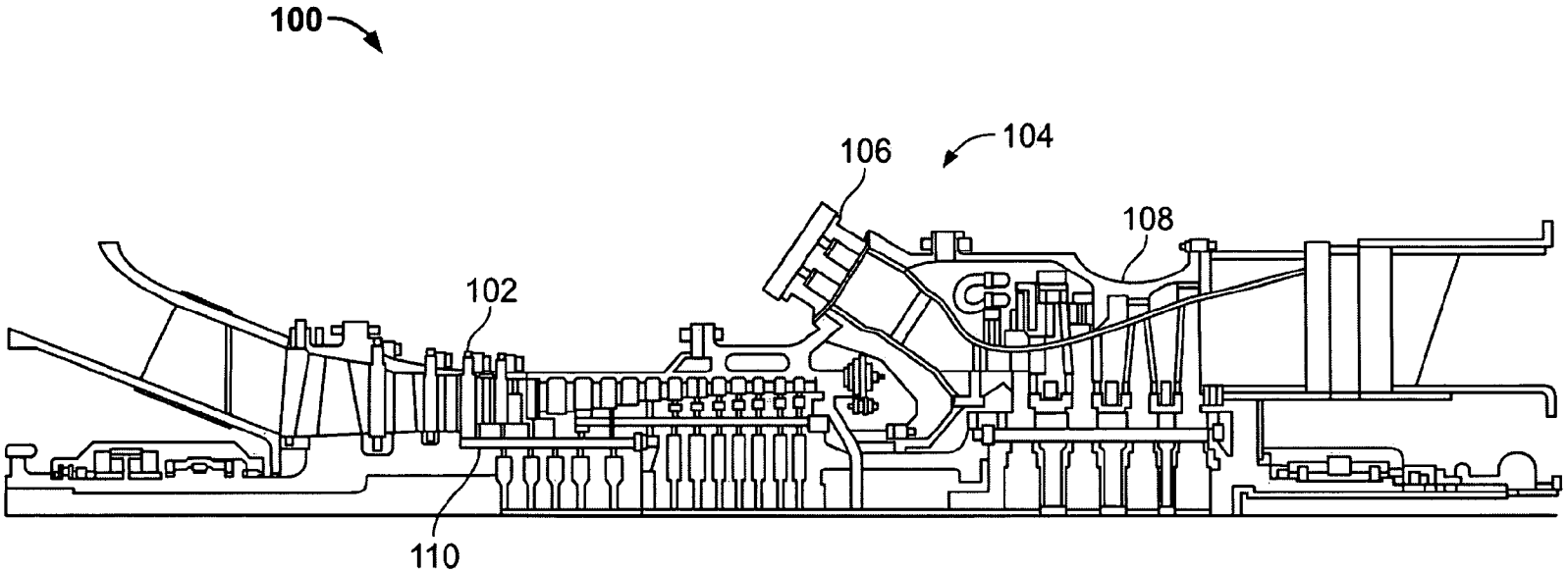
FIG. 1 is a schematic illustration of an exemplary gas turbine engine.

FIG. 1 is a schematic illustration of an exemplary gas turbine engine. Gas turbine engine 100 includes a compressor 102 and a combustor 104, which includes a fuel nozzle assembly 106. Gas turbine engine 100 also includes a turbine 108 and a common compressor/turbine shaft 110. In one embodiment, gas turbine engine 100 is a PG9371 9FBA Heavy Duty Gas Turbine Engine, commercially available from General Electric Company, Greenville, S.C. Notably, the present invention is not limited to any one particular engine and may be used in connection with other gas turbine engines.

During operation, air flows through compressor 102 and compressed air is supplied to combustor 104 and, more specifically, to fuel nozzle assembly 106. Fuel is channeled to a combustion region defined within combustor 104, wherein the fuel is mixed with the compressed air and the mixture is ignited. Combustion gases are generated and channeled to turbine 108, wherein gas stream thermal energy is converted to mechanical rotational energy. Turbine 108 is rotatably coupled to, and drives, shaft 110.

Figure 2:
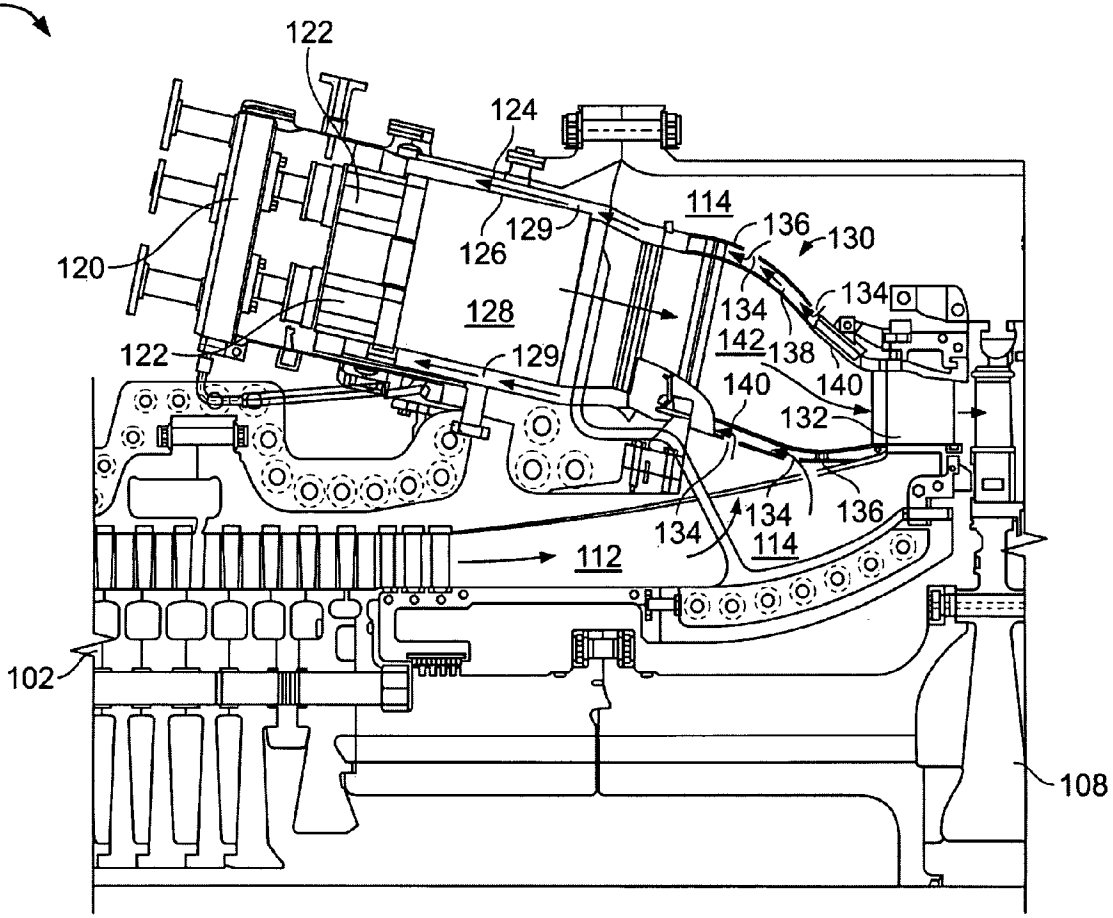
FIG. 2 is a cross-sectional schematic illustration of an exemplary combustor that may be used with the gas turbine engine shown in FIG. 1.

FIG. 2 is a cross-sectional schematic view of combustor 104. Combustor 104 is coupled in flow communication with compressor 102 and turbine 108. Compressor 102 includes a diffuser 112 and a compressor discharge plenum 114 that are coupled in flow communication with each other. Combustor 104 includes an end cover 120 that provides structural support to a plurality of fuel nozzle assemblies 122. End cover 120 is coupled to combustor casing 124 with retention hardware (not shown in FIG. 2). A combustor liner 126 is positioned radially inward from combustor casing 124 such that combustor liner 126 defines a combustion chamber 128 within combustor 104. An annular combustion chamber cooling passage 129 is defined between combustor casing 124 and combustor liner 126. A transition piece 130 is coupled to combustor chamber 128 to facilitate channeling combustion gases generated in combustion chamber 128 downstream towards turbine nozzle 132. In the exemplary embodiment, transition piece 130 includes a plurality of openings 134 formed in an outer wall 136. Transition piece 130 also includes an annular passage 138 that is defined between an inner wall 140 and outer wall 136. Inner wall 140 defines a guide cavity 142. In the exemplary embodiment, fuel nozzle assembly 122 is coupled to end cover 120 via a fuel nozzle flange (not numbered).

During operation, turbine 108 drives compressor 102 via shaft 110 (shown in FIG. 1). As compressor 102 rotates, compressed air is discharged into diffuser 112 as the associated arrows illustrate. In the exemplary embodiment, the majority of air discharged from compressor 102 is channeled through compressor discharge plenum 114 towards combustor 104, and the remaining compressed air is channeled for use in cooling engine components. More specifically, pressurized compressed air within discharge plenum 114 is channeled into transition piece 130 via outer wall openings 134 and into annular passage 138. Air is then channeled from annular passage 138 through annular combustion chamber cooling passage 129 and to fuel nozzle assemblies 122. Fuel and air are mixed, and the mixture is ignited within combustion chamber 128. Combustor casing 124 facilitates shielding combustion chamber 128 and its associated combustion processes from the outside environment such as, for example, surrounding turbine components. Combustion gases generated are channeled from combustion chamber 128 through guide cavity 142 and towards turbine nozzle 132.

Figure 3:
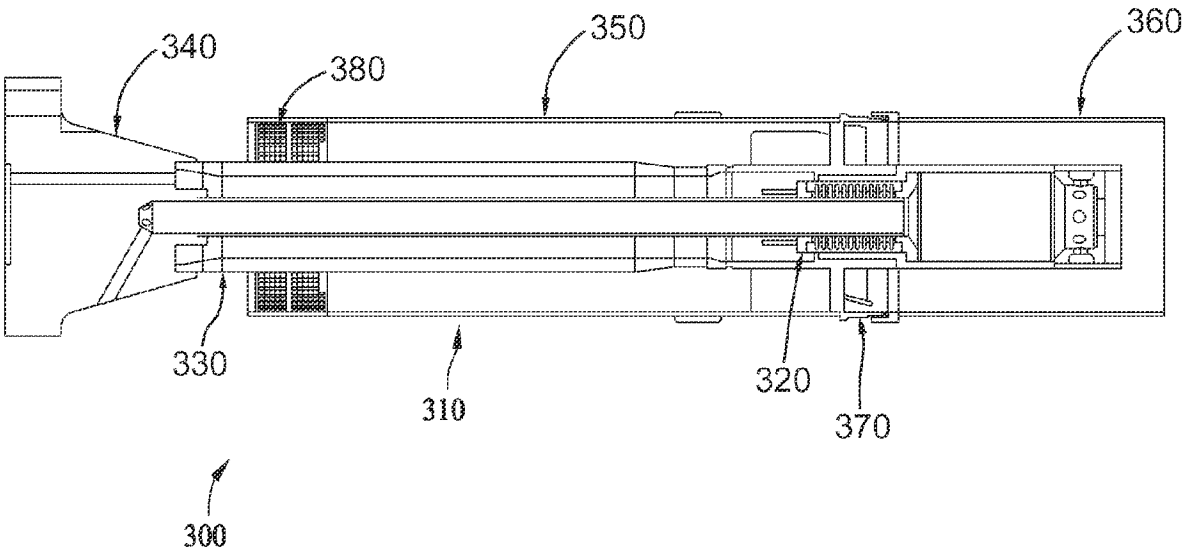
FIG. 3 (PRIOR ART)
FIG. 3 is a cross-sectional schematic illustration of a known fuel nozzle assembly.

FIG. 3 is a cross-sectional schematic illustration of a known fuel nozzle assembly 300. An outermost component of known fuel nozzle assembly 300 is an outer tube 310. Outer tube 310 protects a plurality of internal components such as a swirler assembly 320 and a stem 330 while channeling fluids through known fuel nozzle assembly 300. In the exemplary embodiment, outer tube 310 is assembled from a plurality of components including an upper tube 350, also known as an inlet flow conditioner (IFC), that is welded to an upstream side of a swirler shroud 370 and a lower tube 360, also known as a burner tube, that is welded to a downstream side of swirler shroud 370.

In the exemplary embodiment, outer tube 310 is assembled by tightly rolling at least one piece of sheet metal circumferentially about swirler assembly 320. More specifically, outer tube 310 fully circumscribes and is coupled to swirler assembly 320 via welding. Outer tube 310 includes a plurality of perforated openings 380 defined therein. Perforated openings 380 enable air to enter outer tube 310 at its base end proximate to a flange 340.

Figure 4:
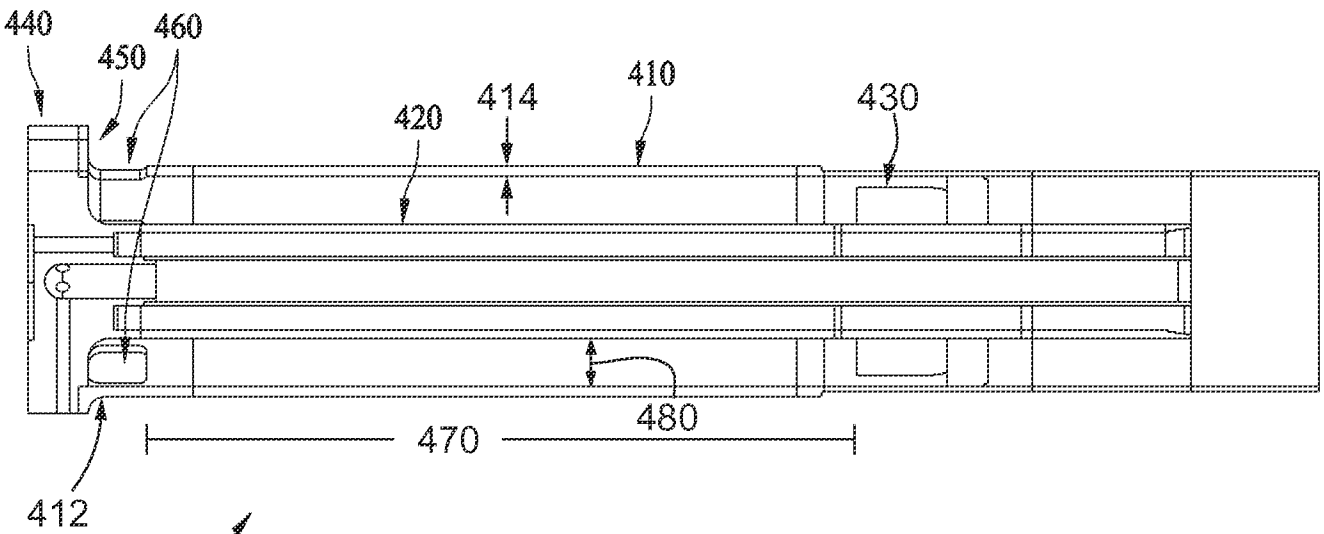
FIG. 4 is a cross-sectional schematic illustration of an exemplary fuel nozzle assembly that may be used with the combustor shown in FIG. 2 that includes a detachable burner tube.

FIG. 4 is a cross-sectional schematic illustration of an exemplary fuel nozzle assembly 400 that includes a detachable burner tube 410, a stem 420, and a swirler assembly 430. In the exemplary embodiment, detachable burner tube 410 is the radially outermost component of fuel nozzle assembly 400 and radially encases fuel nozzle assembly 400. As shown in FIG. 4, detachable burner tube 410 includes a base region 412 and a side wall 414.

In the exemplary embodiment, swirler assembly 430 is fabricated from a first material that has a first coefficient of thermal expansion (CTE), and detachable burner tube 410 is fabricated from a second material that has a second CTE different from the first CTE. Moreover, second material is capable of withstanding higher temperatures than the first material due to its proximity to combustor 104 (shown in FIG. 1). In one embodiment, use of the second material enables detachable burner tube 410 to maintain its shape and resist corrosion and oxidation at material temperatures above approximately 1200° F. In the exemplary embodiment, the respective materials facilitate ensuring that an inner surface defining an inner diameter of detachable burner tube 410 is positioned against an outer surface defining an outer diameter of swirler assembly 430. Specifically, the respective materials facilitate creating a tight seal, at operating temperature, between detachable burner tube 410 and swirler assembly 430 such that the inner diameter of detachable burner tube 410 and the outer diameter of swirler assembly 430 are in structural contact without inducing excessive strain to detachable burner tube 410 or swirler assembly 430 during fuel nozzle operation. More specifically, detachable burner tube 410 and swirler assembly 430 define a joint that provides a structural stiffness of fuel nozzle assembly 400 that is configured to transmit loads during operation. Moreover, the respective materials also facilitate axially sliding, at resting or room temperature, detachable burner tube 410 about stem 420 towards and away from a flange 440.

In an alternate embodiment, a gap is defined between the inner surface defining the inner diameter of detachable burner tube 410 and the outer surface defining the outer diameter of swirler assembly 430 at both resting and operating temperatures. In such an embodiment, the gap does not substantially affect the operation of fuel nozzle assembly 400. In another alternate embodiment, a heat assisted process is used to expand detachable burner tube 410 enough to couple detachable burner tube 410 about stem 420 and swirler assembly 430.

In the exemplary embodiment, detachable burner tube 410 is capable of securely coupling to and easily uncoupling from flange 440 via a coupling mechanism 450. Coupling mechanism 450 may include any apparatus capable of coupling and decoupling detachable burner tube 410 to and from flange 440 including, but not limited to, a bolted joint and/or a cam-locking mechanism. When detachable burner tube 410 is coupled to flange 440, detachable burner tube 410 provides axial support to fuel nozzle assembly 400. More specifically, flange 440 and coupling mechanism 450 are configured to provide vibration robustness to detachable burner tube 410. In the exemplary embodiment, a plurality of air passage openings 460 are formed in side wall 414 and circumscribe base region 412 of detachable burner tube 410 proximate to flange 440 and are sized and configured to facilitate access to coupling mechanism 450.

Coupling mechanism 450 enables detachable burner tube 410 to be easily interchanged, which facilitates improved serviceability. For example, rather than replacing an entire fuel nozzle assembly 400 when a detachable burner tube 410 is damaged or worn, a detachable burner tube 410 to be replaced can be easily uncoupled and replaced by a new detachable burner tube 410. Coupling mechanism 450 also facilitates accessing internal components within fuel nozzle assembly 400 such as stem 420 and swirler assembly 430 for service, repair, and inspection by uncoupling detachable burner tube 410 and recoupling detachable burner tube 410 as necessary.

Moreover, the flexibility of interchanging detachable burner tube 410 facilitates changing an air flow design of fuel nozzle assembly 400 by replacing a detachable burner tube 410 with any one of a plurality of detachable burner tubes 410 of various air flow designs.

During operation, detachable burner tube 410 channels an air flow within fuel nozzle assembly 400. More specifically, air enters fuel nozzle assembly 400 via air passage openings 460 and is channeled through detachable burner tube 410 to swirler assembly 430. In the exemplary embodiment, detachable burner tube 410 facilitates channeling air flow such that the air flow is substantially uniform upstream of swirler assembly 430. More specifically, an axial length 470, between air passage openings 460 and swirler assembly 430, and a radial length 480, between stem 420 and detachable burner tube 410, facilitate channeling a desired air flow. In one embodiment, lengths 470 and 480 facilitate eliminating a need for air guide vanes within swirler assembly 430.

Figure 5:
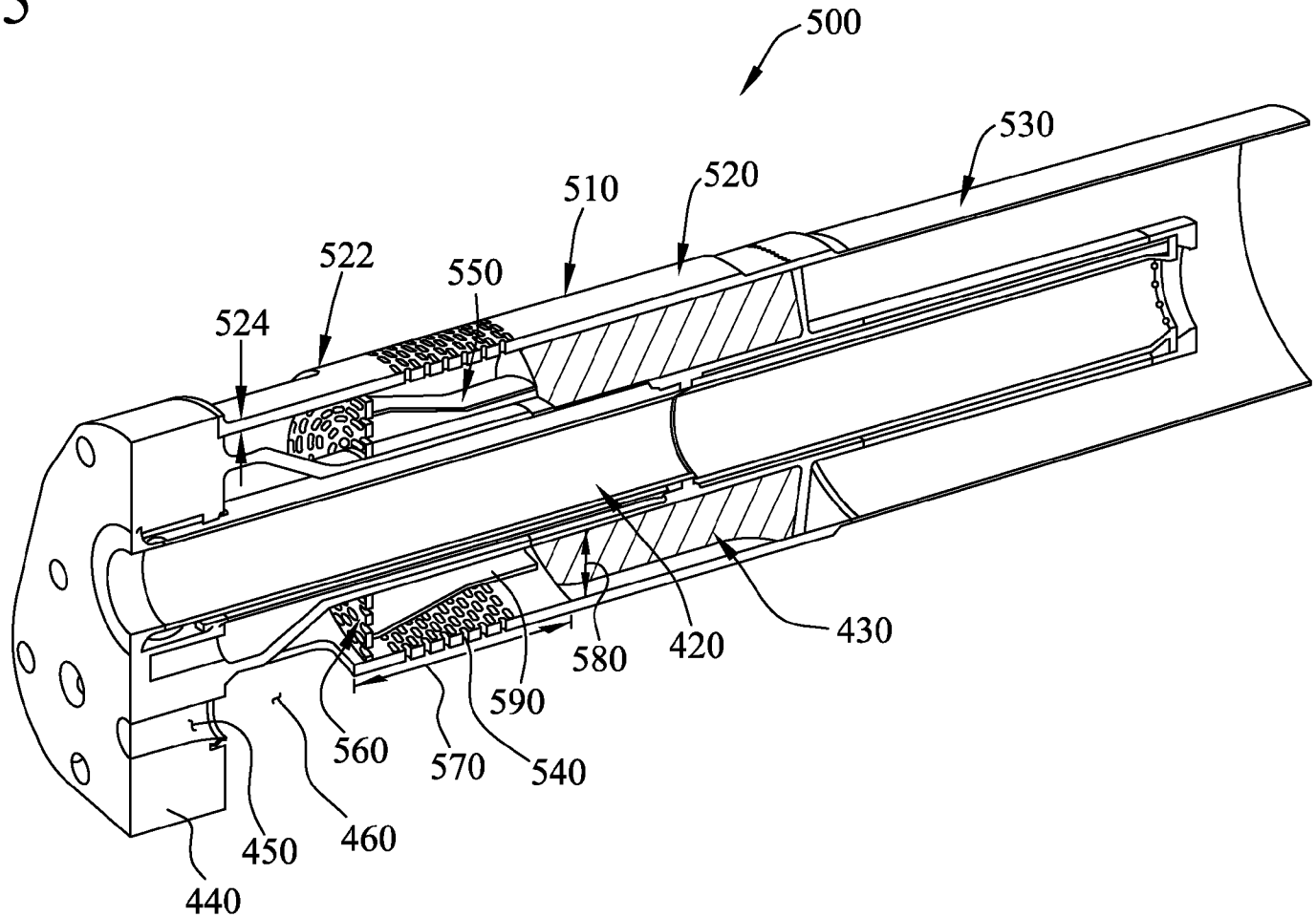
FIG. 5 is a partially broken away perspective of another embodiment of a fuel nozzle assembly that may be used with the combustor shown in FIG. 2.

FIG. 5 is a partially broken away perspective of fuel nozzle assembly 500, which is an alternate embodiment of fuel nozzle assembly 400. In the exemplary embodiment, fuel nozzle assembly 500 includes many of the same components as fuel nozzle assembly 400 as shown in FIG. 4, including stem 420, swirler assembly 430, flange 440, coupling mechanism 450, and plurality of air passage openings 460. Moreover, in the exemplary embodiment, fuel nozzle assembly 500 includes a detachable burner tube 510 with an upper tube 520 proximate to flange 440 and a lower tube 530 proximate to combustor 104 (shown in FIG. 1), a base region 522, a side wall 524, a plurality of perforated openings 540 formed in side wall 524, and a baffle plate assembly 550. In the exemplary embodiment, baffle plate assembly 550 includes a baffle plate 560 and a bell-shaped air guide vane 590 coupled to stem 420. In the exemplary embodiment, baffle plate assembly 550 is positioned radially inward of plurality of perforated openings 540 that are circumferentially spaced about detachable burner tube 510.

In the exemplary embodiment, detachable burner tube 510 includes upper and lower tubes 520 and 530 for cost efficiency purposes. More specifically, lower tube 530 is fabricated from a material that is capable of withstanding high temperatures due to its proximity to combustor 104 (shown in FIG. 1). For example, in the exemplary embodiment, upper tube 520 is fabricated from 410 stainless steel, which has a CTE of 6.4e-6 in/in/° F., and lower tube 530 is fabricated from Hastalloy X, which has a CTE of 8.03e-6 in/in/° F. In one embodiment, use of the material enables lower tube 530 to maintain its shape and resist corrosion and oxidation at material temperatures above approximately 1200° F. In an alternate embodiment, detachable burner tube is fabricated from one material that is capable of withstanding high temperatures due to its proximity to combustor 104 (shown in FIG. 1).

In the exemplary embodiment, swirler assembly 430 is fabricated from a first material that has a first CTE, upper tube 520 is fabricated from a second material that has a second CTE, different from the first CTE. In the exemplary embodiment, the respective materials of swirler assembly 430 and detachable burner tube 510 facilitate ensuring that the inner surface defining the inner diameter of detachable burner tube 510 is positioned against the outer surface defining the outer diameter of swirler assembly 430. In the exemplary embodiment, the respective materials of swirler assembly 430 and upper tube 520 facilitate creating a tight seal, at operating temperature, between upper tube 520 and swirler assembly 430 without inducing excessive strain to upper tube 520 or swirler assembly 430 during fuel nozzle operation. More specifically, upper tube 520 and swirler assembly 430 define a joint that provides a structural stiffness of fuel nozzle assembly 500 that is configured to transmit loads during operation. Moreover, the respective materials of swirler assembly 430 and upper tube 520 also facilitate axially sliding, at resting or room temperature, detachable burner tube 510 about stem 420 towards and away from a flange 440. In the exemplary embodiment, swirler assembly 430 is fabricated from 347 stainless steel, which has a CTE of 9.81e-6 in/in/° F., and upper tube 520 is fabricated from 410 stainless steel, which has a CTE of 6.4e-6 in/in/° F. In another embodiment, the respective materials of swirler assembly 430 and lower tube 530 are selected to facilitate ensuring that the inner surface defining the inner diameter of lower tube 530 is positioned against the outer surface defining the outer diameter of swirler assembly 430 as described above for upper tube 520.

During operation, plurality of perforated openings 540 and baffle plate assembly 550 are positioned downstream from air passage openings 460 to further facilitate channeling a desired air flow within fuel nozzle assembly 500. In one embodiment, baffle plate assembly 550 facilitates channeling a shorter and broader air flow within fuel nozzle assembly 500 than fuel nozzle assembly 400. More specifically, baffle plate assembly 550 enables a configuration of burner tube 510 wherein an axial length 570 is shorter than axial length 470 (shown in FIG. 4) and a radial length 580 is longer than radial length 480 (shown in FIG. 4).

The detachable burner tube described herein facilitates the operation of a gas turbine engine. More specifically, the detachable burner tube described herein simplifies assembly and disassembly of the fuel nozzle and provides vibration robustness, continuity of flow path, and service flexibility. Practice of the methods, apparatus, or systems described or illustrated herein is neither limited to a detachable burner tube nor to gas turbine engines generally. Rather, the methods, apparatus, and systems described or illustrated herein may be utilized independently and separately from other components and/or steps described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Although specific features of various embodiments of the invention may be shown in some drawings and not in others, this is for convenience only. In accordance with the principles of the invention, any feature of a drawing may be referenced and/or claimed in combination with any feature of any other drawing.

While the invention has been described in terms of various specific embodiments, those skilled in the art will recognize that the invention can be practiced with modification within the spirit and scope of the claims.

What is claimed is:

1. A method for assembling a fuel nozzle for use with a combustion chamber defined within a gas turbine engine, said method comprising:

providing a support flange;

providing a swirler assembly;

providing a burner tube, including a base region, a side wall, and a plurality of air passage openings formed in the side wall adjacent to the base region;

providing a baffle plate assembly including a baffle plate and an air guide vane coupled downstream of the baffle plate and located radially inward from the burner tube;

coupling the burner tube to the support flange in a detachable manner, such that an inner surface of the burner tube circumscribes an outer surface of the swirler assembly during fuel nozzle operation; and coupling the baffle plate assembly to a stem that is radially inward from the burner tube, wherein the baffle plate assembly is oriented to channel airflow within the fuel nozzle towards the swirler assembly, wherein the swirler assembly is fabricated from a first material having a first coefficient of thermal expansion and the burner tube is fabricated from a second material having a second coefficient of thermal expansion that is different from the first coefficient of thermal expansion, and wherein at resting temperature, the burner tube is axially slidable towards and away from the support flange.

2. A method for assembling a fuel nozzle in accordance with claim 1, wherein the burner tube is fabricated from the second material and a third material, wherein the third material is capable of withstanding a higher material temperature than the second material.

3. A method for assembling a fuel nozzle in accordance with claim 1, wherein said coupling the burner tube further comprises:

coupling the burner tube such that the burner tube loosely circumscribes the swirler assembly at the resting temperature and firmly circumscribes the swirler assembly at an operating temperature.

4. A fuel nozzle configured to channel fluid toward a combustion chamber defined within a gas turbine, said fuel nozzle comprising:

a support flange;

a swirler assembly;

a burner tube comprising a base region, a side wall, and a plurality of air passage openings formed in the side wall adjacent to said base region; and a baffle plate assembly comprising a baffle plate and an air guide vane coupled downstream of the baffle plate and located radially inward from said burner tube, wherein said baffle plate assembly is oriented to channel airflow within said fuel nozzle towards the swirler assembly, wherein said burner tube is coupled to said support flange in a detachable manner, such that an inner surface of said burner tube circumscribes an outer surface of said swifter assembly during fuel nozzle operation, wherein said swirler assembly is fabricated from a first material having a first coefficient of thermal expansion and said burner tube is fabricated from a second material having a second coefficient of thermal expansion that is different from the first coefficient of thermal expansion, and wherein at resting temperature, said burner tube is axially slidable towards and away from said support flange.

5. A fuel nozzle in accordance with claim 4, wherein said first coefficient of thermal expansion is higher than said second coefficient of thermal expansion.

6. A fuel nozzle in accordance with claim 4, wherein said burner tube is fabricated from the second material and a third material, wherein said third material is capable of withstanding a higher material temperature than said second material.

7. A fuel nozzle in accordance with claim 4, wherein said burner tube loosely circumscribes said swirler assembly at the resting temperature and firmly circumscribes said swirler assembly at an operating temperature.

8. A gas turbine engine comprising:

a combustion chamber; and a fuel nozzle configured to channel fluid toward said combustion chamber, said fuel nozzle comprising:

a swirler assembly;

a burner tube comprising a base region, a side wall, and a plurality of air passage openings formed in the side wall adjacent to said base region;

a support flange; and a baffle plate assembly comprising a baffle plate and an air guide vane coupled downstream of the baffle plate and located radially inward from said burner tube, wherein said baffle plate assembly is oriented to channel airflow within said fuel nozzle towards the swirler assembly, wherein said burner tube is coupled to said support flange in a detachable manner, such that an inner surface of said burner tube circumscribes an outer surface of said swirler assembly during fuel nozzle operation, wherein said swirler assembly is fabricated from a first material having a first coefficient of thermal expansion and said burner tube is fabricated from a second material having a second coefficient of thermal expansion that is different from the first coefficient of thermal expansion, and wherein at resting temperature, said burner tube is axially slidable towards and away from said support flange.

9. A gas turbine engine in accordance with claim 8, wherein said first coefficient of thermal expansion is higher than said second coefficient of thermal expansion.

10. A gas turbine engine in accordance with claim 8, wherein said burner tube is fabricated from the second material and a third material, and wherein said third material is capable of withstanding a higher material temperature than said second material.

11. A gas turbine engine in accordance with claim 8, wherein said burner tube loosely circumscribes said swirler assembly at a resting temperature and firmly circumscribes said swirler assembly at an operating temperature.

* * * * *